US007306222B2

(12) United States Patent
Kaya et al.

(10) Patent No.: US 7,306,222 B2
(45) Date of Patent: Dec. 11, 2007

(54) SHEET MATERIAL FEEDER

(75) Inventors: Mehmet Oktay Kaya, Lee, NH (US); Edward James Limbert, Monroe, OH (US)

(73) Assignee: Goss International Americas, Inc., Dover, NH (US)

( * ) Notice: Subject to any disclaimer, the term of this patent is extended or adjusted under 35 U.S.C. 154(b) by 80 days.

(21) Appl. No.: 10/437,577

(22) Filed: May 14, 2003

(65) Prior Publication Data

US 2004/0245697 A1 Dec. 9, 2004

(51) Int. Cl.
*B65H 5/02* (2006.01)

(52) U.S. Cl. ..... 271/276; 271/197; 271/95

(58) Field of Classification Search ..... 271/11, 271/91, 95, 99, 276, 196, 197, 112, 270; 101/419, 488; 400/579, 582
See application file for complete search history.

(56) References Cited

U.S. PATENT DOCUMENTS

| | | | | | |
|---|---|---|---|---|---|
| 2,413,358 | A | * | 12/1946 | Kleineberg | 270/52.29 |
| 2,936,681 | A | * | 5/1960 | Earp | 493/310 |
| 3,173,684 | A | * | 3/1965 | Binzoni et al. | 271/122 |
| 3,552,740 | A | * | 1/1971 | Hepp | 271/12 |
| 3,599,541 | A | * | 8/1971 | Allen | 493/310 |
| 3,602,495 | A | * | 8/1971 | Hepp | 271/12 |
| 3,806,111 | A | * | 4/1974 | Lachman et al. | 270/52.28 |
| 3,976,291 | A | * | 8/1976 | Bernardi et al. | 271/94 |
| 4,138,101 | A | * | 2/1979 | Faltin | 270/52.19 |
| 4,290,595 | A | * | 9/1981 | Thunker | 271/277 |
| 4,358,100 | A | * | 11/1982 | Muller | 271/11 |
| 4,491,311 | A | | 1/1985 | Glanzmann | 270/54 |
| 4,596,545 | A | * | 6/1986 | Greenwell | 493/315 |
| 4,603,848 | A | * | 8/1986 | Markgraf et al. | 271/125 |
| 4,976,420 | A | * | 12/1990 | Flensburg et al. | 270/52.28 |
| 5,028,043 | A | * | 7/1991 | Karolyi | 271/14 |
| 5,080,341 | A | * | 1/1992 | Luthy | 271/12 |
| 5,116,452 | A | * | 5/1992 | Eder | 156/566 |
| 5,169,285 | A | * | 12/1992 | Muller | 414/797.8 |
| 5,215,515 | A | * | 6/1993 | Bershadsky | 493/315 |
| 5,308,056 | A | * | 5/1994 | Achelpohl | 271/183 |
| 5,531,433 | A | | 7/1996 | Hawkes et al. | 271/10.01 |
| 5,862,684 | A | * | 1/1999 | Park | 68/4 |
| 5,910,078 | A | * | 6/1999 | Guttinger et al. | 493/309 |
| RE36,329 | E | * | 10/1999 | Laroche | 493/96 |
| 5,979,889 | A | * | 11/1999 | Klopfenstein | 271/11 |

(Continued)

FOREIGN PATENT DOCUMENTS

| | | |
|---|---|---|
| DE | 876848 | 5/1953 |

(Continued)

*Primary Examiner*—Patrick Mackey
*Assistant Examiner*—Thomas Morrison
(74) *Attorney, Agent, or Firm*—Davidson, Davidson & Kappel, LLC

(57) ABSTRACT

A sheet material feeder includes a sheet material holder for holding a pile of sheet material, a rotating drum for transporting the sheet material from the pile, and an acceleration device receiving the sheet material from the rotating drum at a first speed and releasing the sheet material at a second speed greater than the first speed. Also disclosed is a sheet material feeder with a sheet material holder for holding a pile of sheet material; and a rotating drum for transporting the sheet material from the pile, the rotating drum including at least one sucker rotating with the drum for contacting the sheet material.

8 Claims, 13 Drawing Sheets

U.S. PATENT DOCUMENTS

| | | | | |
|---|---|---|---|---|
| 6,050,563 | A * | 4/2000 | Vedoy et al. | 271/10.07 |
| 6,082,724 | A | 7/2000 | Kahlig et al. | 270/52.14 |
| 6,189,452 | B1 * | 2/2001 | Halup et al. | 101/415.1 |
| 6,543,767 | B1 | 4/2003 | Krouse | 271/270 |
| 6,619,652 | B2 * | 9/2003 | Belec | 271/82 |
| 6,719,031 | B2 * | 4/2004 | Sawai | 156/519 |
| 2002/0125629 | A1 * | 9/2002 | Keller | 271/11 |

FOREIGN PATENT DOCUMENTS

| | | | |
|---|---|---|---|
| DE | 19738920 | * | 3/1999 |
| EP | 0405107 | | 3/1994 |
| EP | 0708044 | | 4/1996 |
| EP | 1020385 | | 7/2000 |
| JP | 4-269594 | | 9/1992 |

* cited by examiner

SHEET MATERIAL FEEDER

BACKGROUND INFORMATION

The present invention relates to sheet material feeders, for example hoppers for feeding sheet material such as signatures, individual sheets or inserts from a pile.

German Patent Application No. 197 38 920 for example discloses a feeder for taking a signature from a pile of signatures using a suction device, which passes the signature to a rotating drum. Grippers on further opening drums then open the signatures as the signatures are transported to a saddle-back conveyor.

U.S. Pat. No. 6,213,457 discloses an apparatus for feeding flat products from a pile using a sucker and conveying belts. The flat products are then passed to a feeder conveyor, either directly or via a gripper drum running at a stable surface speed ten percent greater than the speed of the flat products.

BRIEF SUMMARY OF THE INVENTION

A problem with conventional feeders is that the separation process for the bottom sheet material is prone to difficulties at high speeds. For example, inertial forces and vacuum building for the suckers creates limits on the speed for the feeder.

The present invention provides a sheet material feeder comprising: a sheet material holder for holding a pile of sheet material; a rotating drum for transporting the sheet material from the pile; and an acceleration device receiving the sheet material from the rotating drum at a first speed and releasing the sheet material at a second speed greater than the first speed.

By providing an acceleration device in conjunction with the rotating drum, the drum can rotate at a slower speed to remove the sheet material from the pile, while the acceleration device provides for increased delivery of the sheet material. Thus for a particular feeder speed, removal of the sheet material can occur more effectively due to the lower rotating drum speed.

The acceleration device preferably includes a plurality of variable-speed belts, and may further include two intake nip rollers and two output nip rollers over which the belts run. The surface speed of the output nip rollers is then greater than the surface speed of the input nip rollers.

The rotating drum preferably includes a plurality of grippers, so that more than one sheet material is obtained from the stack per revolution of the drum.

The grippers preferably include a first gripper part and a second gripper part, each gripper part being individually actuable.

The holder may include an adjustable bottom tray, and a restrictor.

A caliper and pressure roller may be provided to interact with the gripper drum prior to the acceleration device. The roller may be eccentrically mounted.

Preferably, the drum further includes suckers. The suckers thus are no longer separate from the drum, and may be actuated by rotation of the drum.

The present invention thus also provides a sheet material feeder comprising: a sheet material holder for holding a pile of sheet material; and a rotating drum for transporting the sheet material from the pile, the rotating drum including at least one sucker rotating with the drum for contacting the sheet material.

By having the sucker rotate with the drum, complex reciprocating parts such as independent suck bars and lift feet may be eliminated.

BRIEF DESCRIPTION OF THE DRAWING

The present invention will be described with respect to a preferred embodiment in which.

DETAILED DESCRIPTION

Figure 1:
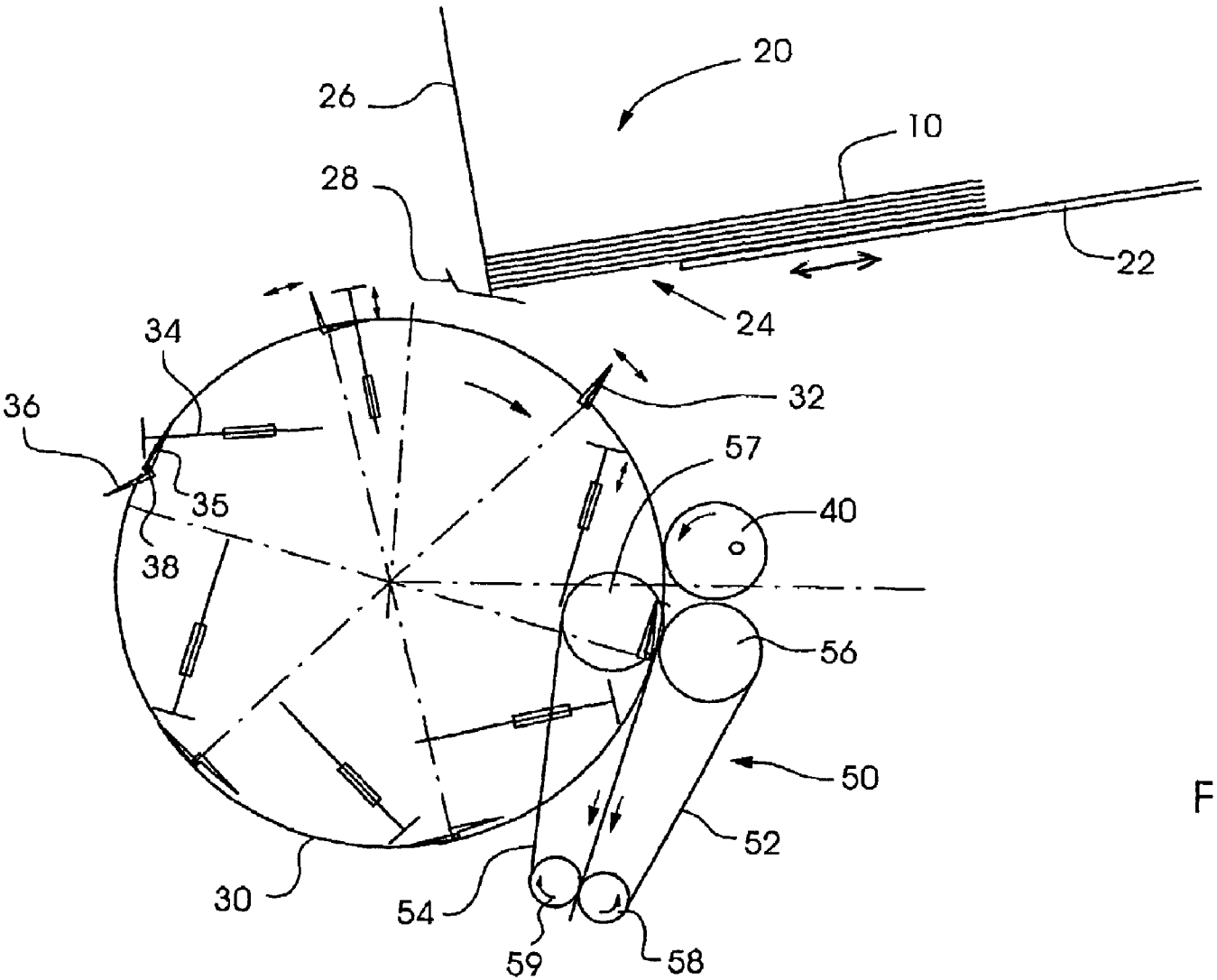
FIG. 1 shows a side view of a preferred embodiment of the present invention.

FIG. 1 shows a side view of a preferred embodiment of the feeder of the present invention. Sheet material 10 is held in a holder 20, which has an adjustable bottom tray 22 and a bottom opening 24. Bottom tray 22 is adjustable to alter the size of the opening 24. Sheet material 10 may include signatures, which have a folded edge resting against a front wall 26. An adjustable restrictor 28 may protrude from the front wall into bottom opening 24.

The feeder further includes a rotating drum 30 having a plurality of grippers 32 and suckers 34, which can be connected to cam followers and moved and actuated by cams adjustable for various sheet material 10 lengths. Each gripper 32 has a first gripper part 35 and a second gripper part 36, which pivot about a pivot point 38 and each of which may have its own cam. The two gripper parts 35, 36 may be spring-forced together, so that the cams for each part operate to open the spring. A plurality of grippers 32 and suckers 34 may be spaced axially on the drum 30, the grippers 32 and suckers 34 preferably alternating and being spaced axially apart.

The suckers 34 can take suction from an adjustable vacuum pad on drum 30, which may be connected to a vacuum source apart from drum 30.

Interacting with an outer surface of drum 30 is an eccentrically-mounted rotating pressure roller 40, located in front of an acceleration device 50. Acceleration device 50 includes two take-off belts 52, 54, which are spaced axially in radial gaps in the drum 30, and thus spaced axially with respect to grippers 32 and suckers 34 as well. Belts 52, 54 are driven by input rollers 56, 57 and/or output rollers 58, 59 and have a variable speed. Preferably the surface speed of belts 52, 54 at input rollers 56, 57 is equal to the surface speed of the drum 30, which may rotate at a constant speed. The belts accelerate through the device 50, so that the surface speed of the belts 52, 54 at the output rollers 58, 59 is greater than at the input rollers 56, 57. The variable-speed drive for the rollers may include elliptical gears, a Geneva mechanism, or a separate servo-drive. Holding devices also could be provided on the belts.

FIGS. 2 to 13 show the gripping of a bottommost one of the sheet material 10 for one set of grippers 32 and suckers 34.

Figure 2:
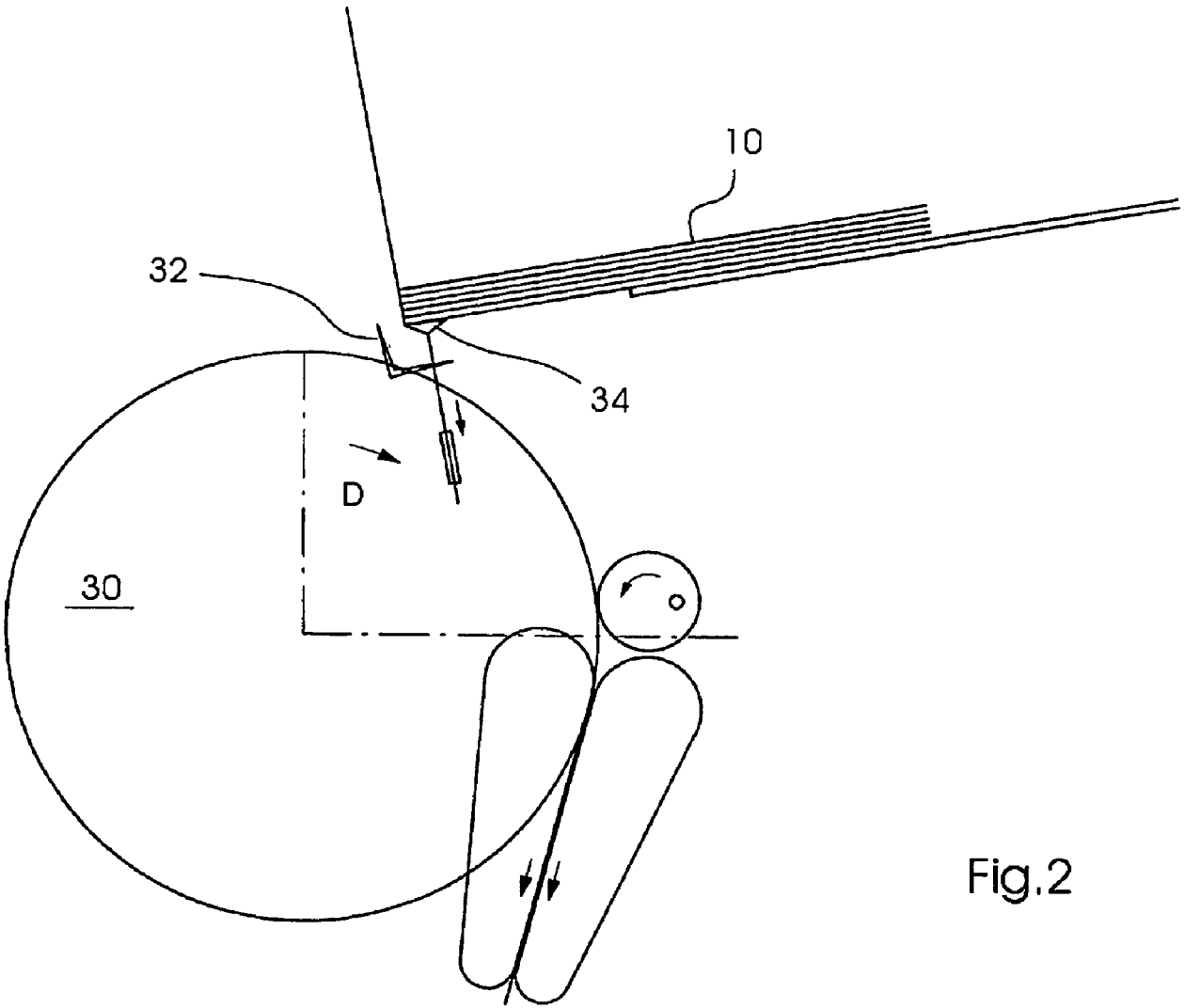
FIG. 2 shows a first step of sheet material removal from on the sucker/gripper pairs of the rotating drum.
Figure 3:
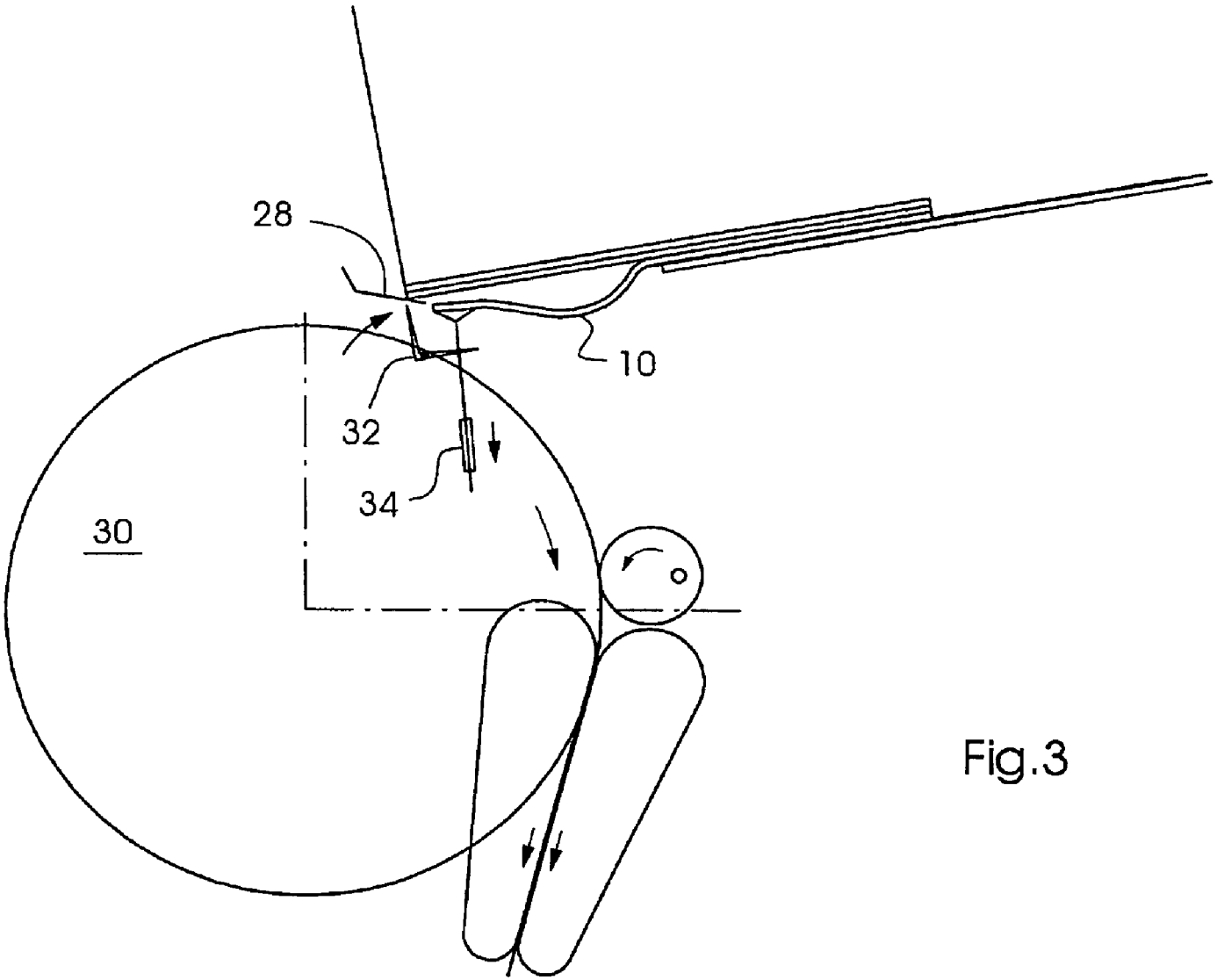
FIGS. 3, 4, 5, 6, 7, 8, 9, 10, 11, 12 and 13 shows steps subsequent to the step in FIG. 2.

FIG. 2 shows a sucker 34 attached to sheet material 10, as drum 30 rotates in direction D. Sucker 34 pulls sheet material 10 downwardly, so that the vacuumed sheet material 10 passes the restrictor 28, as shown in FIG. 3.

Figure 4:
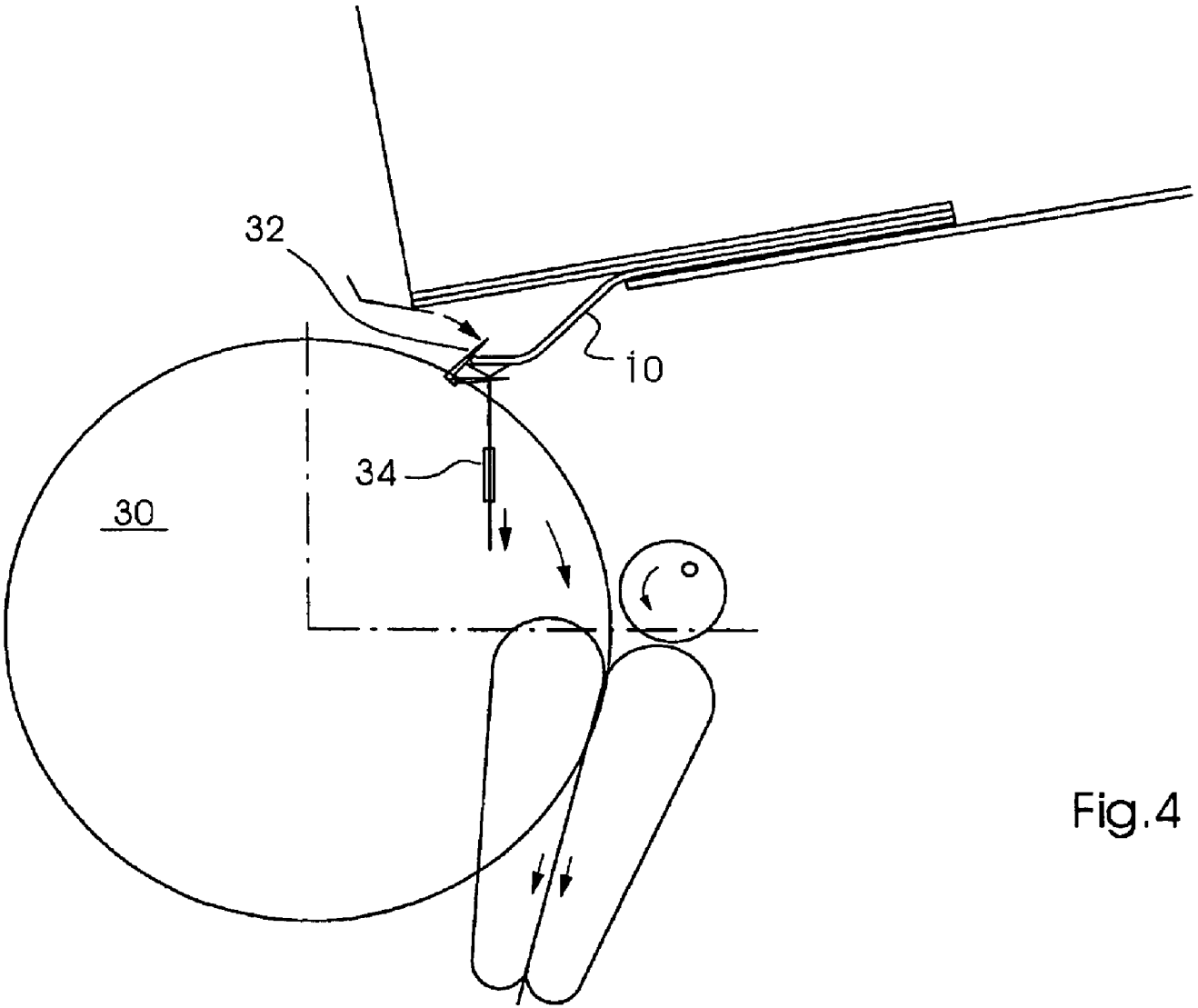
Figure 5:
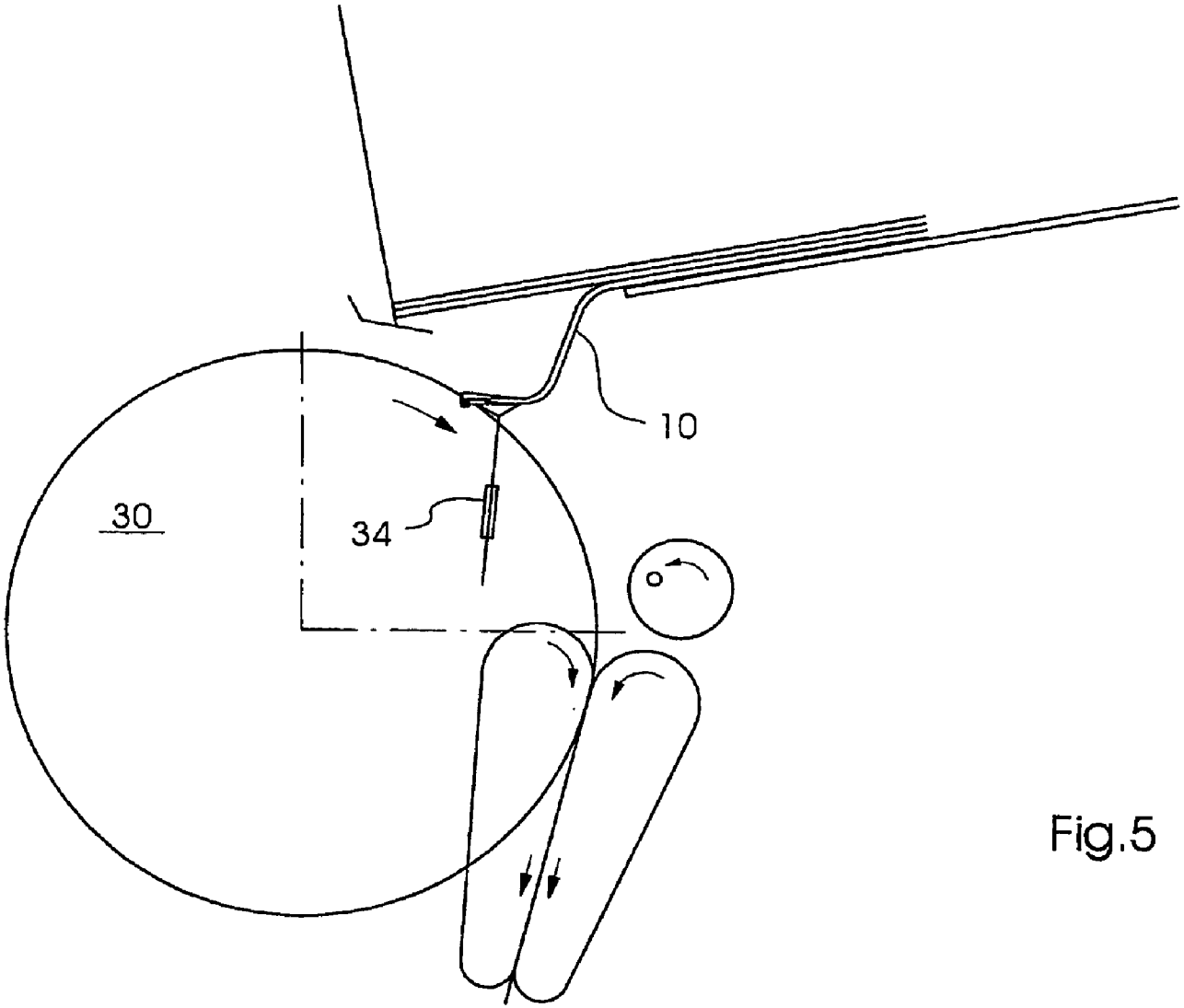

Sucker 34 then pulls sheet material 10 to gripper 32, which then grips the front edge of sheet material 10, as shown in FIGS. 4 and 5.

Figure 6:
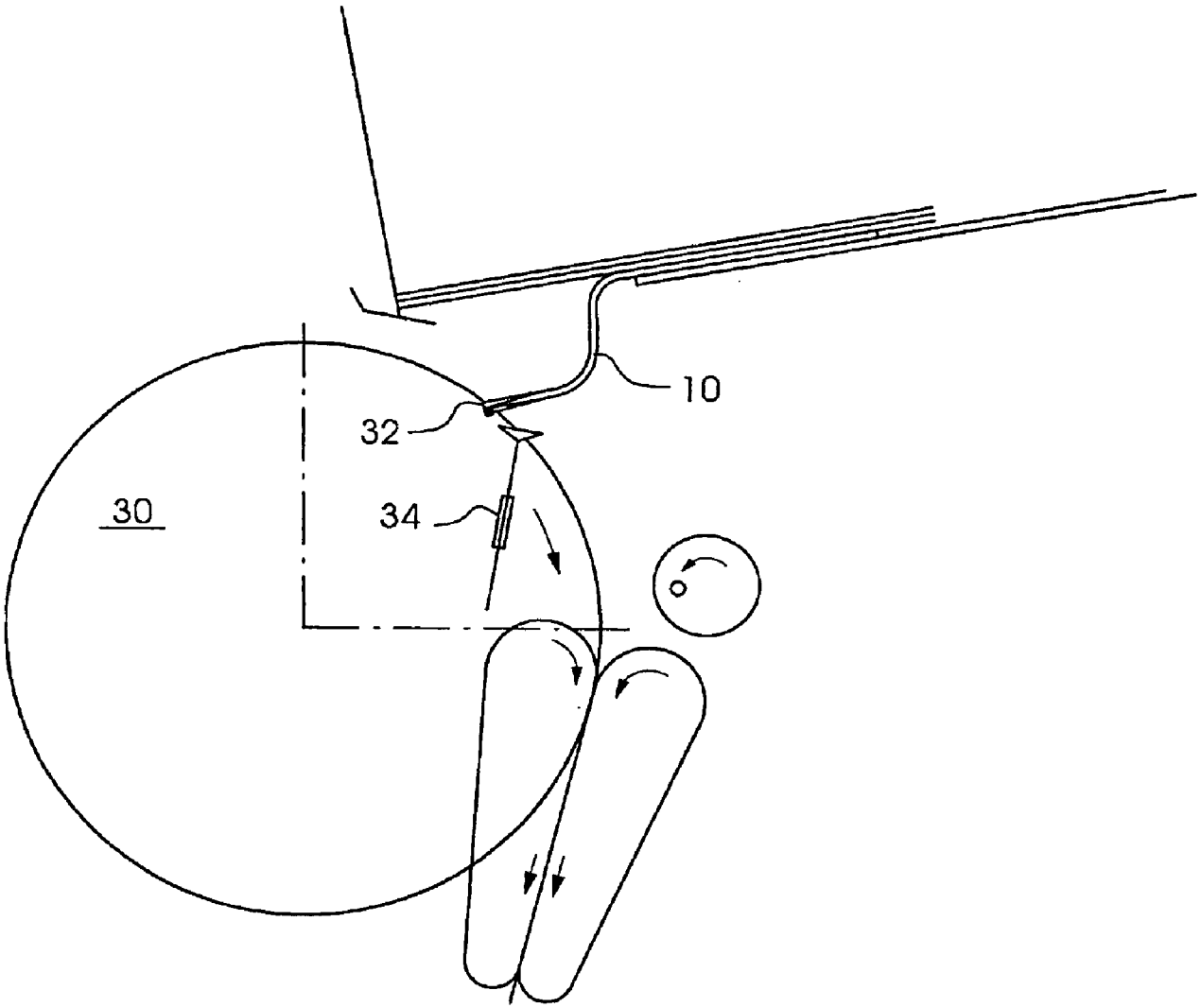
Figure 7:
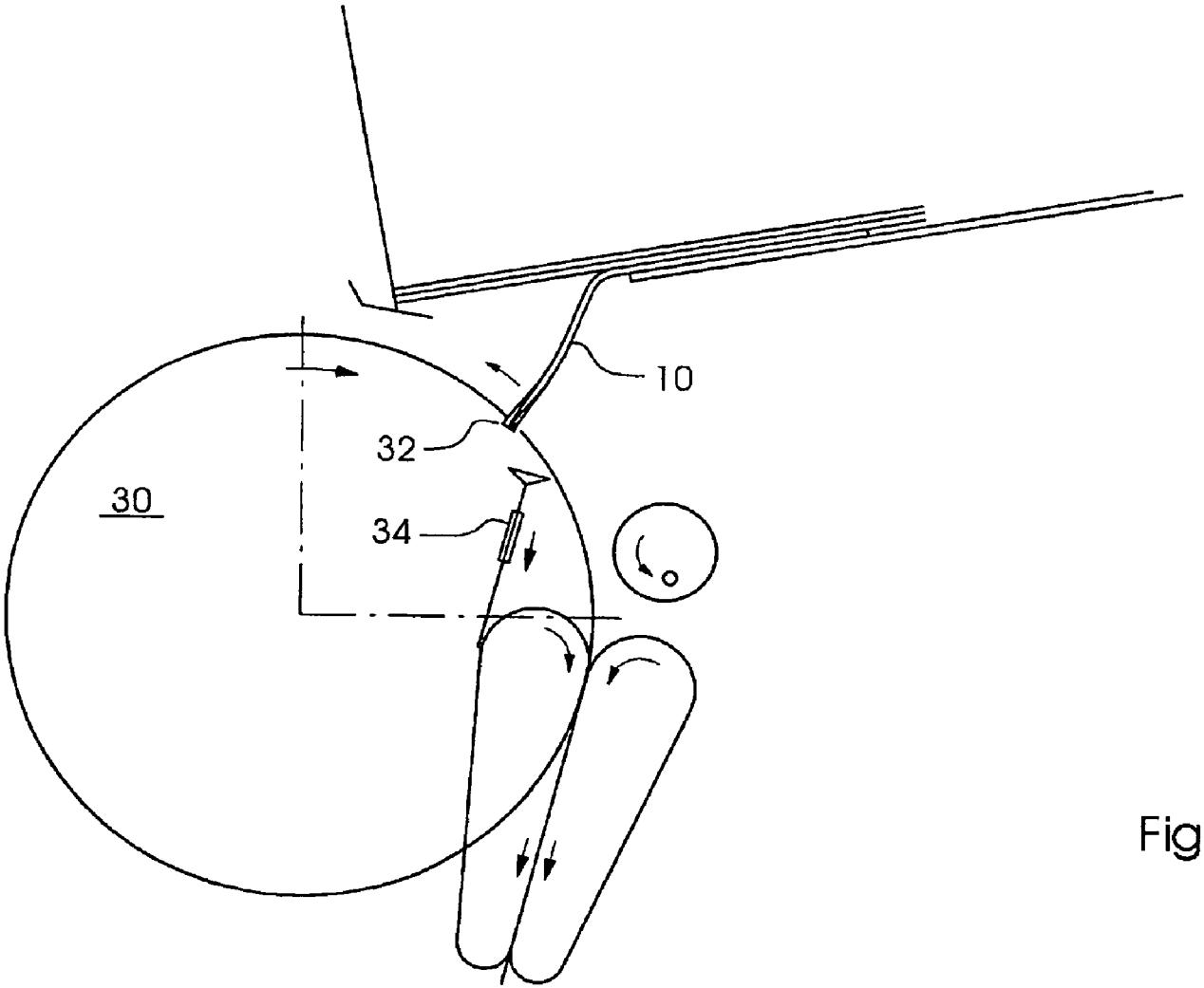
Figure 8:
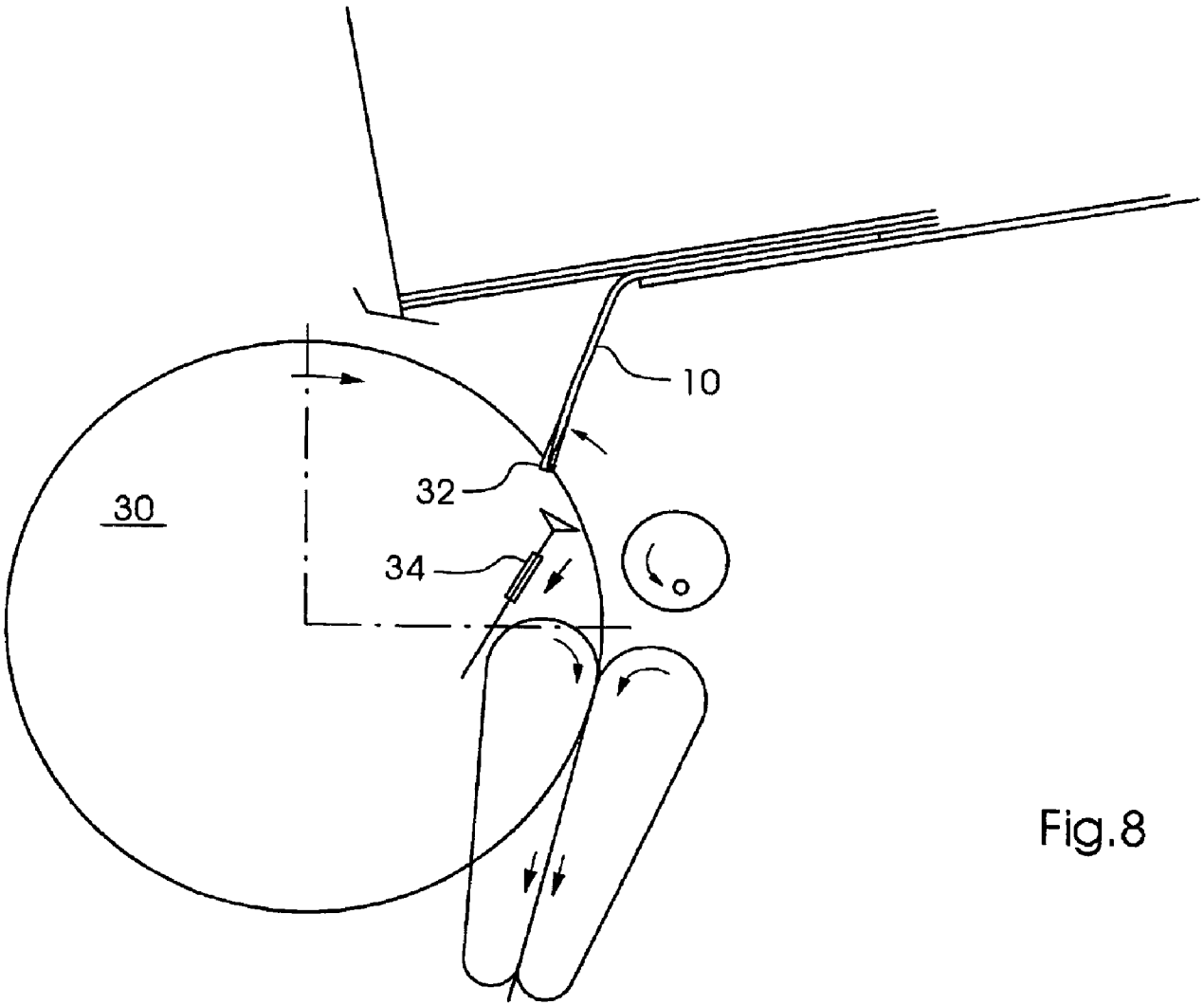

Once the sheet material is gripped the vacuum to sucker 34 is cut and gripper 32 moves counterclockwise to free the sheet material 10 from sucker 34, as shown in FIGS. 6, 7 and 8. Sucker 34 retracts into drum 30.

Figure 9:
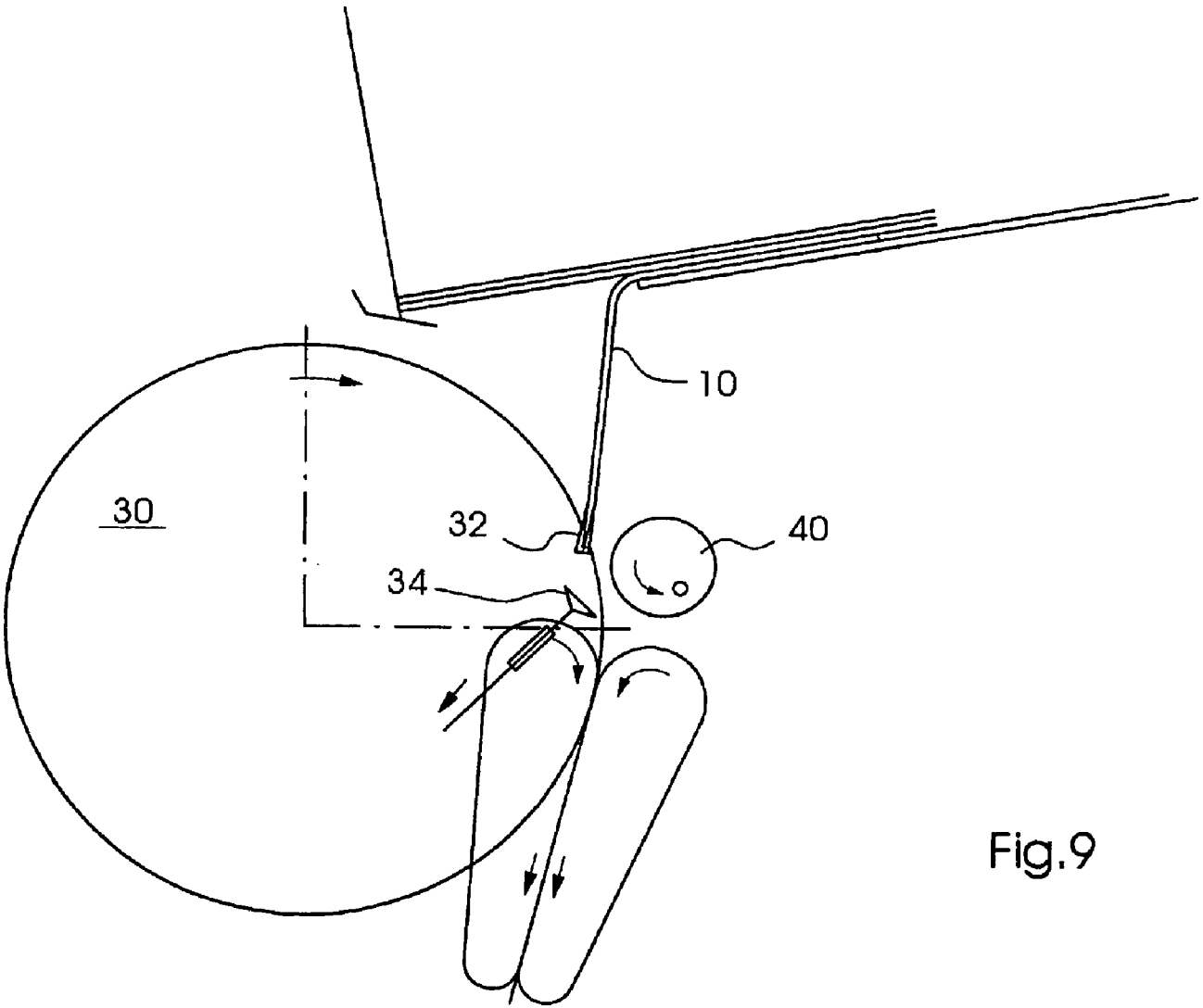

Sheet material 10 is then pressed against the outer surface of drum 30 by pressure roller 40, while grippers 32 still grip sheet material 10, as shown in FIG. 9. Pressure roller 40 may be made of a plurality of axially-spaced disks, the grippers 32 passing between the axial spaced of the disks. Pressure roller 40 may be eccentric so that contact with drum 30 is selective and space is provided for sheet material 10 as sheet material 10 approaches pressure roller 40, this space being shown schematically in FIGS. 4 to 8.

Figure 10:
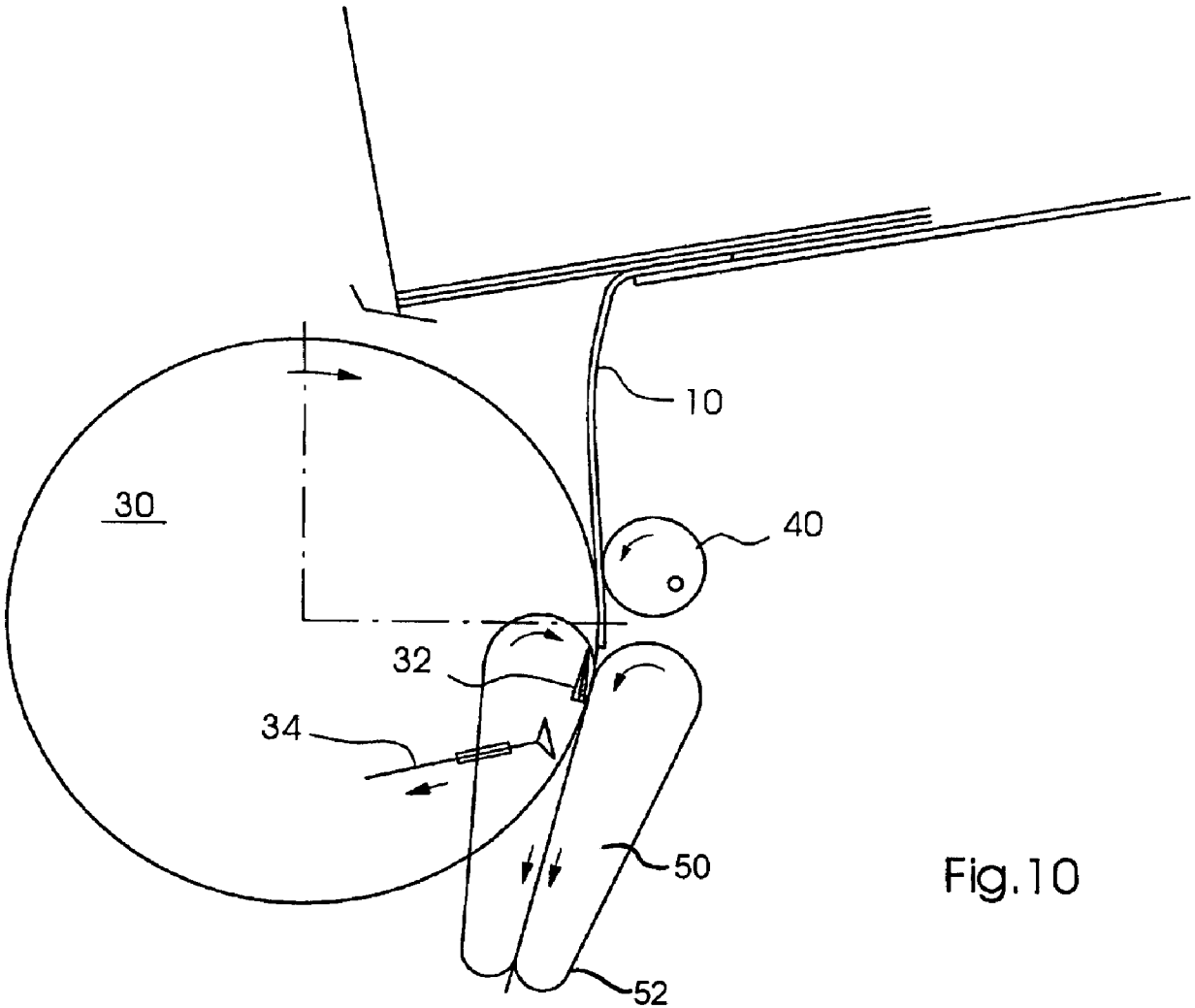
Figure 11:
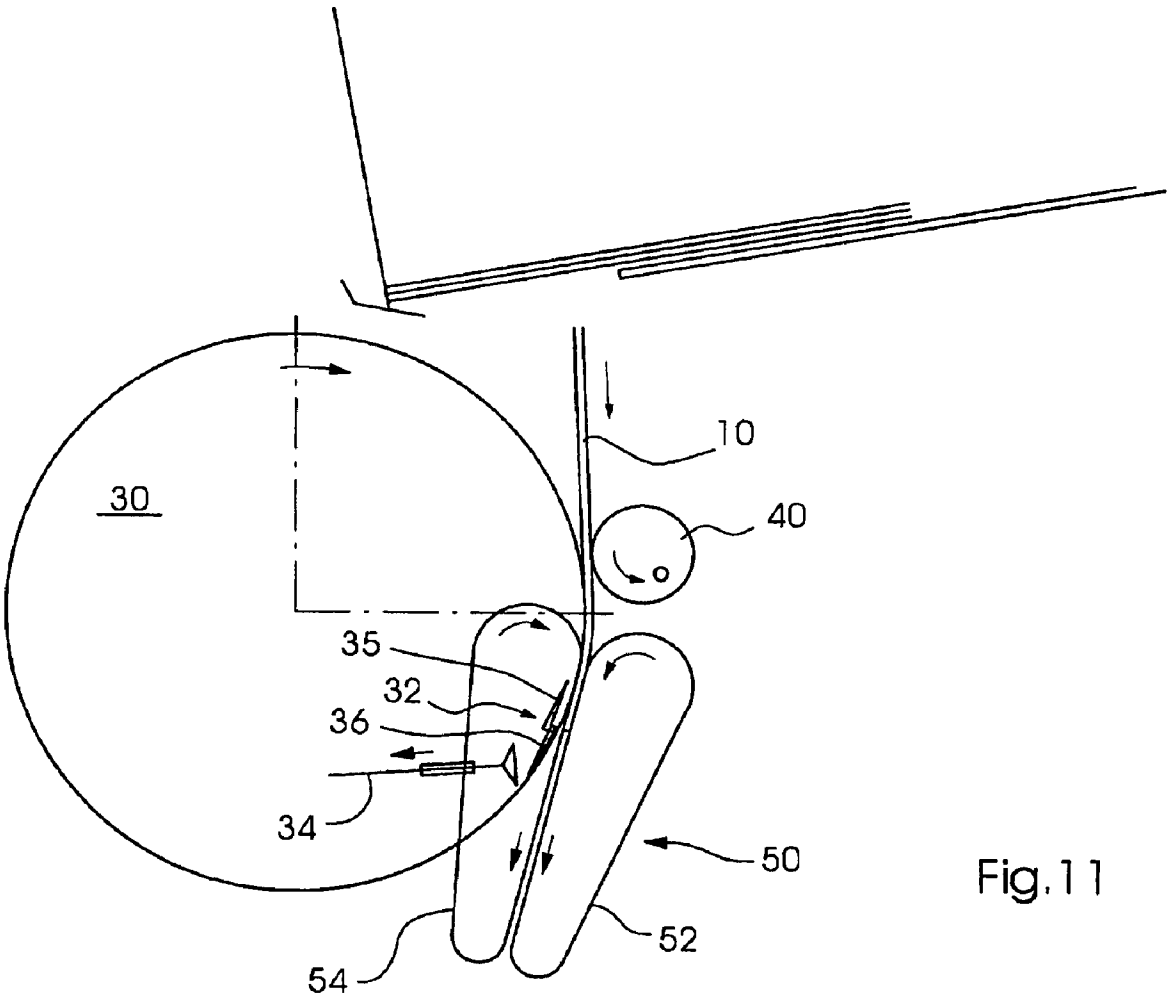

FIG. 10 shows sheet material 10 entering acceleration device 50. Once sheet material 10 enters belts 52, 54, the second gripper part 36 is rotated as shown in FIG. 11 so that gripper 32 opens and sheet material 10 can pass second gripper part 36 as sheet material accelerates through acceleration device 50.

Figure 12:
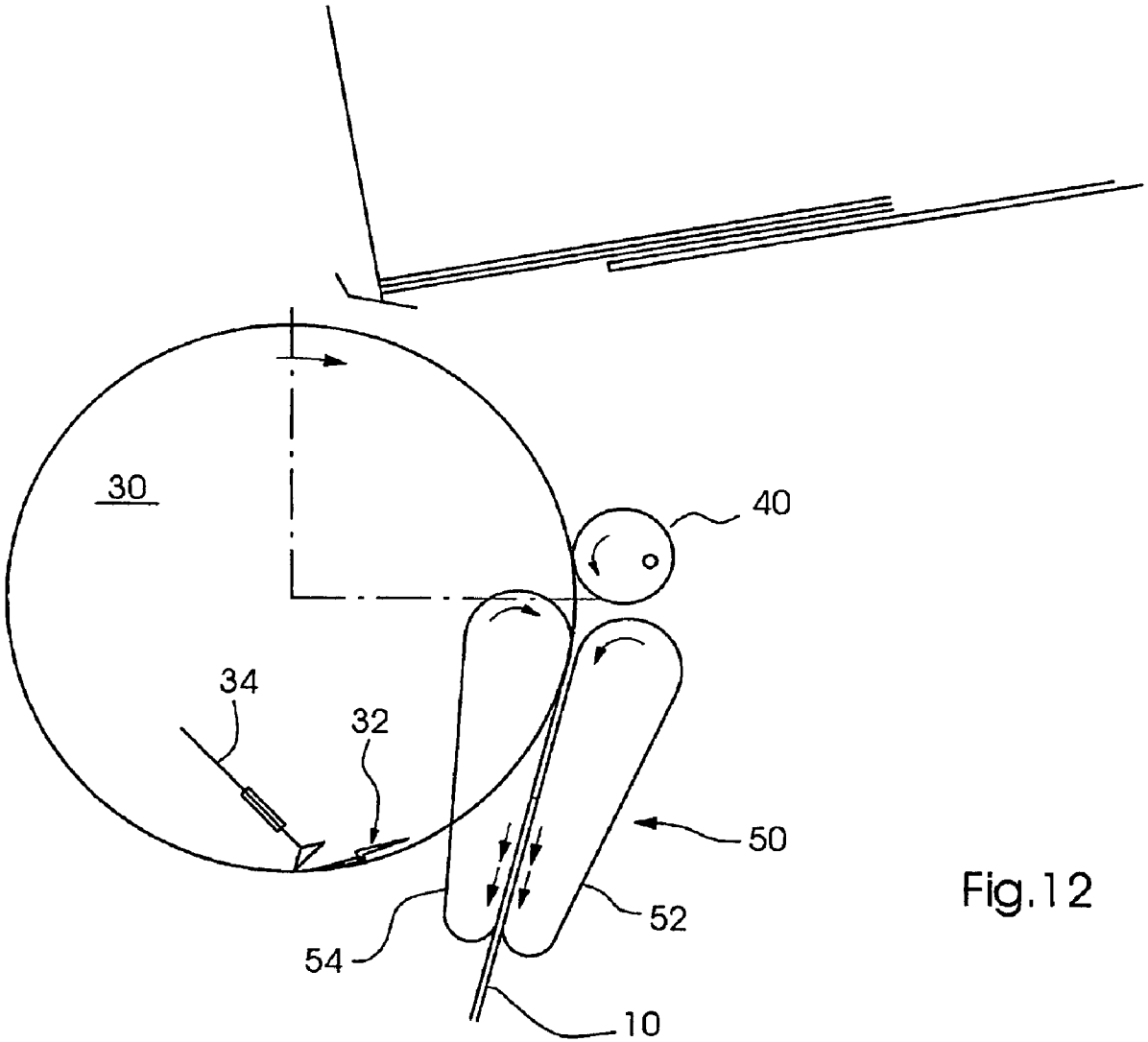
Figure 13:
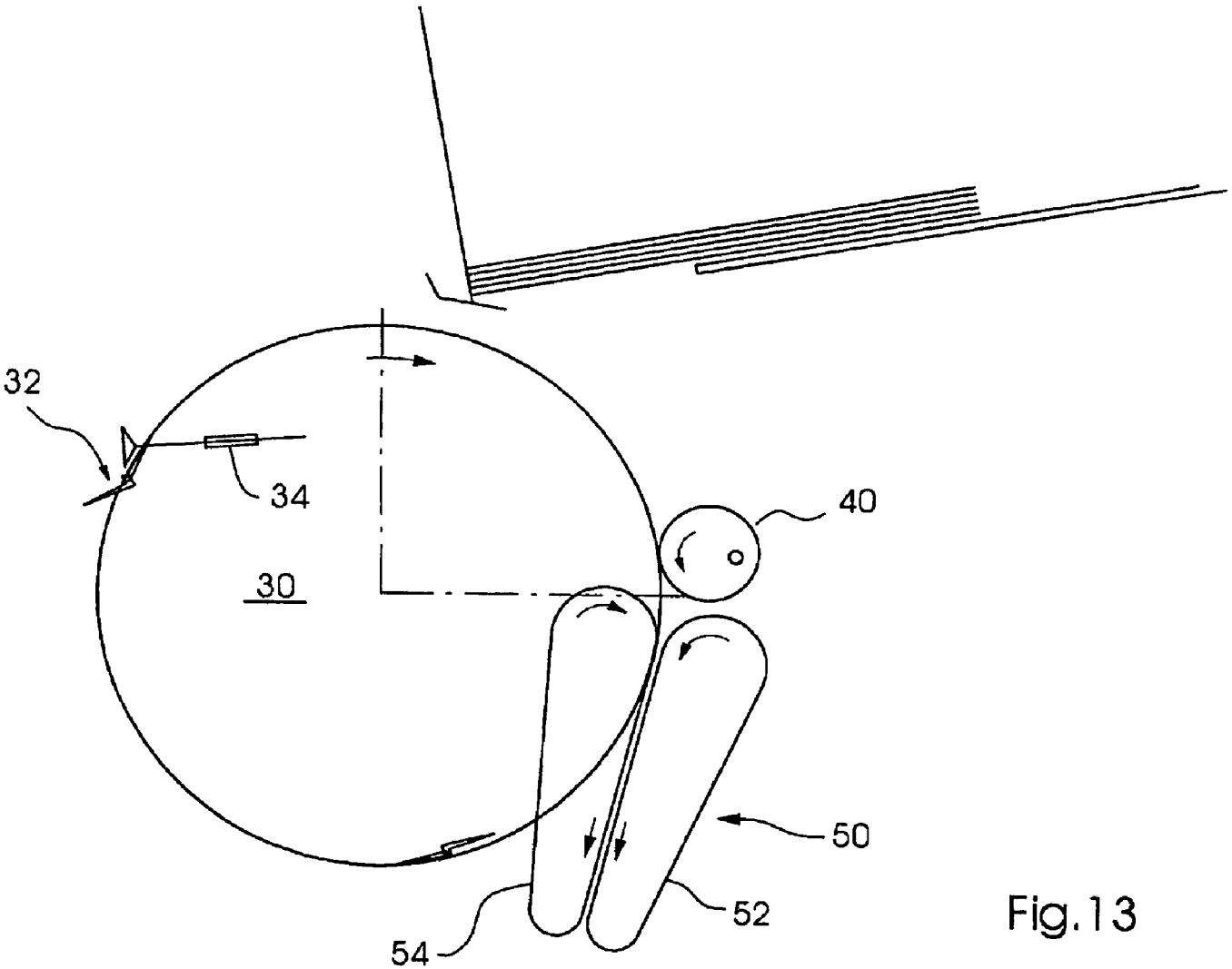

FIG. 12 shows sheet material 10 exiting acceleration device 50, and FIG. 13 shows gripper 32 returning to grip the another piece of sheet material 10.

Since many grippers 32, for example 4, 6 or 8, may be spaced circumferentially about the drum 30, the drum 30 can pull off a plurality of pieces of sheet material 10 per revolution at a speed slow enough to ensure good transfer from the holder 20, while acceleration device 50 ensures that feeder throughput is not degraded.

While the present invention has been described with respect to a preferred embodiment, a similar device could be used for example in a forced shingling device (where the drum would rotate in the opposite direction and shingle the sheet material 10). The feeder could be used in a saddle stitcher or for perfect binding.

What is claimed is:

1. A sheet material feeder comprising:

a sheet material holder for holding a pile of sheet material;

a rotating drum for transporting the sheet material from the pile;

an acceleration device receiving the sheet material from the rotating drum at a first location at a first speed and releasing the sheet material at a second location at a second speed greater than the first speed, the acceleration device accelerating the sheet material between the first and second locations; wherein the acceleration device includes a plurality of variable-speed belts and input rollers and output rollers, the belts running around the input and output rollers, a surface speed of the belts at the input rollers being equal to a surface speed of the rotating drum; and a pressure roller interacting with the rotating drum prior to the acceleration device, the roller being eccentrically mounted.

2. The sheet material feeder as recited in claim 1 wherein the rotating drum includes a plurality of grippers spaced circumferentially about the rotating drum.

3. The sheet material feeder as recited in claim 1 wherein the holder includes a bottom tray and a sheet material restrictor.

4. The sheet material feeder as recited in claim 1 wherein the drum includes at least one sucker rotating with the drum.

5. The sheet material feeder as recited in claim 2 wherein the drum includes at least one sucker for each of the circumferentially-spaced grippers.

6. A sheet material feeder comprising:

a sheet material holder for holding a pile of sheet material;

a rotating drum for transporting the sheet material from the pile, the rotating drum having an outer circumferential surface and including at least one sucker rotating with the drum, the at least one sucker extending radially beyond the outer circumferential surface for contacting the sheet material in a first rotational position of the drum and being retracted to be radially inside the outer circumferential surface in a second rotational position of the drum;

an acceleration device for receiving the sheet material from the rotating drum, the acceleration device including a plurality of variable-speed belts and input rollers and output rollers, the belts running around the input and output rollers, a surface speed of the belts at the input rollers being equal to a surface speed of the rotating drum; and a pressure roller interacting with the rotating drum prior to the acceleration device, the roller being eccentrically mounted.

7. A sheet material feeder comprising:

a sheet material holder for holding a pile of sheet material;

a rotating drum for transporting the sheet material from the pile;

an acceleration device receiving the sheet material from the rotating drum at a first location at a first speed and releasing the sheet material at a second location at a second speed greater than the first speed, the acceleration device accelerating the sheet material between the first and second locations; wherein the acceleration device includes a plurality of variable-speed belts; and a pressure roller interacting with the rotating drum prior to the acceleration device, the roller being eccentrically mounted.

8. A sheet material feeder comprising:

a sheet material holder for holding a pile of sheet material;

a rotating drum for transporting the sheet material from the pile, the rotating drum having an outer circumferential surface and including at least one sucker rotating with the drum, the at least one sucker extending radially beyond the outer circumferential surface for contacting the sheet material in a first rotational position of the drum and being retracted to be radially inside the outer circumferential surface in a second rotational position of the drum;

an acceleration device for receiving the sheet material from the rotating drum, the acceleration device including a plurality of variable-speed belts; and a pressure roller interacting with the rotating drum prior to the acceleration device, the roller being eccentrically mounted.

* * * * *